US007124834B2

(12) United States Patent
Sundholm et al.

(10) Patent No.: US 7,124,834 B2
(45) Date of Patent: Oct. 24, 2006

(54) METHOD AND SYSTEM FOR EXTINGUISHING A FIRE

(75) Inventors: Goran Sundholm, Tuusula (FI); Maarit Tuomisaari, Espoo (FI)

(73) Assignee: Marioff Corporation Oy, Vantaa (FI)

( * ) Notice: Subject to any disclaimer, the term of this patent is extended or adjusted under 35 U.S.C. 154(b) by 68 days.

(21) Appl. No.: 10/517,737

(22) PCT Filed: Jun. 24, 2003

(86) PCT No.: PCT/FI03/00512

§ 371 (c)(1),
(2), (4) Date: Dec. 9, 2004

(87) PCT Pub. No.: WO2004/002575

PCT Pub. Date: Jan. 8, 2004

(65) Prior Publication Data

US 2006/0048951 A1 Mar. 9, 2006

(30) Foreign Application Priority Data

Jun. 28, 2002 (FI) ..... 20021274

(51) Int. Cl.

| | |
|---|---|
| ***A62C 2/00*** | (2006.01) |
| ***A62C 3/00*** | (2006.01) |
| ***A62C 2/08*** | (2006.01) |
| ***A62C 35/00*** | (2006.01) |
| ***A62C 37/00*** | (2006.01) |
| ***A62C 37/10*** | (2006.01) |

(52) U.S. Cl. ..... 169/46; 169/16; 169/48; 169/56; 169/60

(58) Field of Classification Search ..... 169/46, 169/16, 48, 56, 60, 45, 37; 405/132
See application file for complete search history.

(56) References Cited

U.S. PATENT DOCUMENTS

| | | | | |
|---|---|---|---|---|
| 5,617,922 | A | 4/1997 | Sundholm | |
| 5,909,777 | A * | 6/1999 | Jamison | 169/43 |
| 6,065,546 | A * | 5/2000 | Uetake et al. | 169/61 |
| 6,216,793 | B1 * | 4/2001 | Sundholm | 169/54 |
| 6,296,062 | B1 * | 10/2001 | Sundholm | 169/37 |
| 6,415,871 | B1 * | 7/2002 | Sundholm | 169/54 |
| 6,418,752 | B1 * | 7/2002 | Kotliar | 62/640 |

(Continued)

FOREIGN PATENT DOCUMENTS

| | | |
|---|---|---|
| EP | 0388 033 | 9/1990 |

(Continued)

OTHER PUBLICATIONS

Patent Abstracts of Japan of JP 2003-00746 Dated Jan. 7, 2003.

*Primary Examiner*—Dinh Q. Nguyen
*Assistant Examiner*—Darren Gorman
(74) *Attorney, Agent, or Firm*—Ladas & Parry LLP

(57) ABSTRACT

Method for extinguishing a fire in a space, especially in a tunnel or equivalent, in which method an extinguishing medium is sprayed in the space by means of spraying heads. In a first stage of the method, the flow and temperature of the hot gases produced by the fire are influenced by spraying an extinguishing medium into the space, especially by creating in the space at least one curtain (7) of extinguishing medium, and at least some spraying heads (11, 12) in the space are pre-activated into a state of readiness, and in a second stage at least one spraying head is activated to produce a spray of extinguishing medium. The invention also concerns an apparatus.

18 Claims, 3 Drawing Sheets

U.S. PATENT DOCUMENTS 6,962,207 B1 * 11/2005 Sundholm ..... 169/9

FOREIGN PATENT DOCUMENTS

JP 2003-000746 1/2003

WO WO 01/26742 * 4/2001
WO 02/058794 8/2002
WO 03/022364 3/2003

* cited by examiner

METHOD AND SYSTEM FOR EXTINGUISHING A FIRE

BACKGROUND OF THE INVENTION

The present invention relates to a method as defined in the preamble of claim 1 for extinguishing a fire in a space, especially in a tunnel or equivalent, in which method an extinguishing medium is sprayed in the space by means of spraying heads.

The invention also relates to a fire extinguishing apparatus as defined in the preamble of claim 11.

In recent times, the question of firefighting in tunnels, such as road and railway tunnels and equivalent, has emerged. Several destructive fires have occurred in tunnels because they generally have no permanent fire extinguishing systems. The traditionally imaginable fire extinguishing systems are either sprinkler systems or zonewise triggered spraying systems. In sprinkler systems, the sprinklers are triggered individually by the action of heat. In a tunnel application, they involve the problem that, as a consequence of the fast propagation of hot gases, a very large number of them are triggered even far away from the actual place of fire. Therefore, the pump sizes and correspondingly the pipe sizes should be designed for such a large area that the system would become practically unfeasible. In a zonewise triggered system, the tunnel is divided into zones, and when a signal based on fire detection is received from a zone, the entire zone is triggered. A problem with these systems is how to locate the right zone. Due to the fast propagation of smoke and heat, signals may be received from numerous wrong zones, and again the practical problems of sizing are encountered. Therefore, a special area of investigation in recent times has been the development of new and accurate detection systems.

A problem with all traditional solutions is the difficulty of directing the extinguishing power of automatic firefighting equipment to the right area, i.e. to the area on fire. In tunnels there is always a strong air current, either due to natural ventilation or—more generally—produced by mechanical ventilation. The hot combustion gases rise up and are quickly drifted in the tunnel away from the actual area on fire. Therefore, individual heat-activated sprinklers of conventional sprinkler systems are triggered in a very large area. The capacity of the extinguishing system is soon exceeded and the best extinguishing power may even be applied to a completely wrong area where no seat of fire exists at all. Dimensioning the system for such a large area in practice leads to impossible water quantities and pipe sizes. Alternatively, the system may be triggered a complete zone at a time, but for the selection of the right zone it is necessary to have an advanced detection system in addition to the extinguishing system. These problems are fairly well avoided in the apparatus disclosed in specification WO 0126742 (FI patent 108216). The object of the present invention is to further develop the method and system according to the prior-art solution, especially in connection with firefighting in tunnels.

BRIEF DESCRIPTION OF THE INVENTION

The object of the present invention is to achieve a completely new type of solution that makes it possible to focus the extinguishing power of a fire extinguishing system to the actual fire area, either completely without a separate detection system or by using a less sensitive and therefore cheaper detection system. Such a fire extinguishing system can be so dimensioned that it will be feasible in practice. Another object of the invention is to achieve an efficient fire extinguishing system designed to be applied for extinguishing fires occurring in tunnels.

The invention is based on a concept which provides that, at the beginning of the extinguishing operation, a curtain or curtains of extinguishing medium is/are formed across the tunnel, and at least some of the spraying heads, preferably on either side of the curtain of extinguishing medium, are brought into a position of readiness. The curtain limits the flow of hot gases in the tunnel and cools them enough to ensure that, if a "wrong" zone is in a state of readiness, preferably none of the heat-activated spraying heads will be triggered. Very soon the "right" zone will be selected and the heat generated by the fire will start triggering spraying heads in the very area on fire and in its vicinity. The right zone is selected automatically. At first, one or more curtains of extinguishing medium in a wrong zone may be triggered, but the amount of water produced by them is insignificant as compared with the amount of water in a complete zone. The curtain of extinguishing medium and the associated zone may be activated either by a heat-activated triggering means, such as an ampoule, or on the basis of a separate detection system.

More closely defined, the method of the invention is mainly characterized in that, in a first stage of the method, the flow and temperature of the hot gases produced by the fire are influenced by spraying an extinguishing medium Into the space, especially by creating at least one curtain of extinguishing medium in the space, and at least some spraying heads in the space are pre-activated into a state of readiness, and in a second stage at least one spraying head is activated to produce a spray of extinguishing medium.

The method of the invention is additionally characterized by what is stated in claims 2–10.

The apparatus of the invention is characterized in that it comprises first nozzles, preferably in first spraying heads, for producing at least one curtain of extinguishing medium in a space and a number of spraying heads comprising a protecting means, such as a protecting cup, for protecting at least one nozzle and/or heat-activated triggering means of the spraying head, said apparatus being operated in stages, wherein in a first stage at least one curtain of extinguishing medium is formed, preferably by means of the first nozzles of the first spraying heads, and a number of second spraying heads are pre-activated by releasing the protecting element covering the nozzle and/or heat-activated triggering means, and In a second stage one or more of the second spraying heads are activated to produce a spray of extinguishing medium.

The apparatus of the invention is additionally characterized by what is stated in claims 12–18.

The solution of the invention has numerous significant advantages. By using the solution of the Invention, an extinguishing system can be more accurately designed because the occurrences of spraying heads being triggered in a wrong zone are either completely prevented or at least minimized. By creating a curtain of extinguishing medium, efficient cooling is produced in the space and the propagation of hot gases is limited. In addition, when the spraying heads are pre-activated and the protecting means covering the heat-activated triggering means of the second spraying heads are removed, the possibility of spurious triggering is minimized. The curtain of extinguishing medium further reduces the possibility of spurious triggering of the next curtains and the associated zones. By using heat-activated triggering means in the second spraying heads, the extinguishing effect of the extinguishing system of the invention can be applied to the area on fire.

BRIEF DESCRIPTION OF THE FIGURES

In the following, the invention will be described in detail by the aid of an example with reference to the attached drawing, wherein.

DETAILED DESCRIPTION OF THE INVENTION

Figure 1:
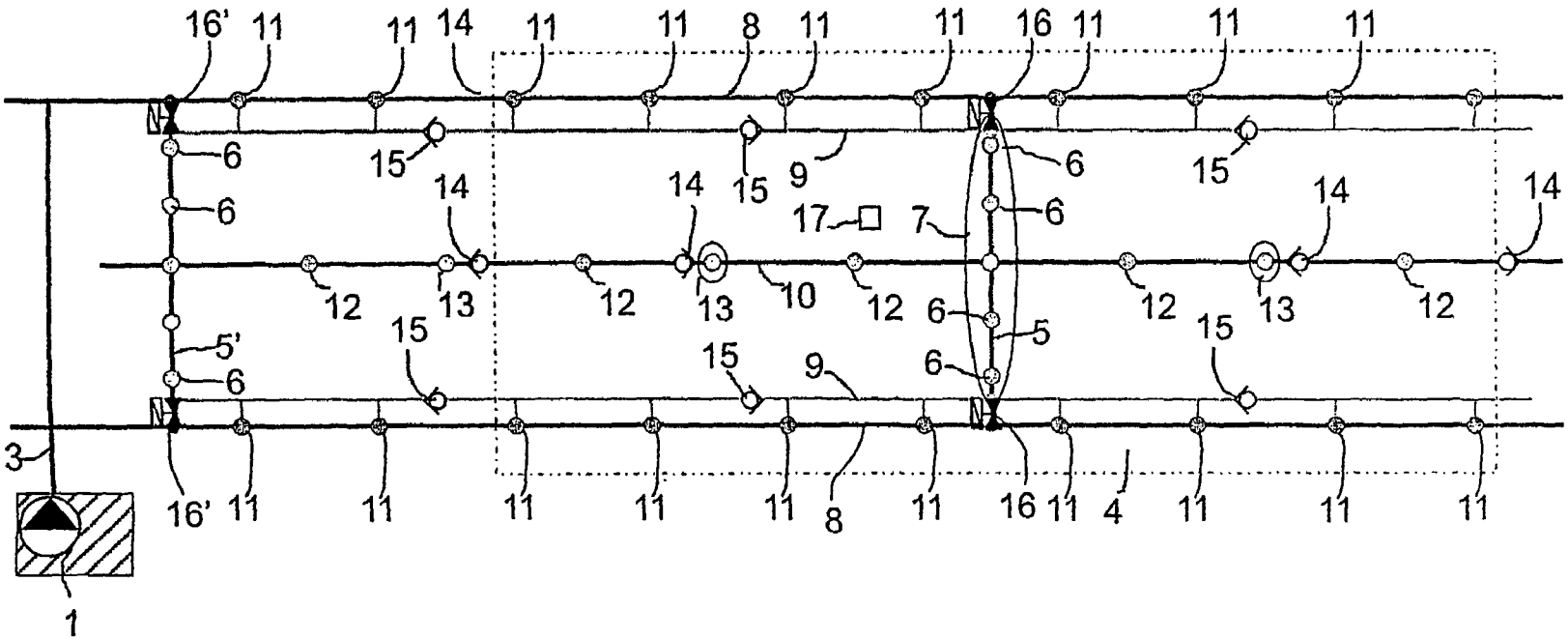
FIG. 1 presents a diagrammatic top view of a part of the apparatus shown in FIG. 2.
Figure 2:
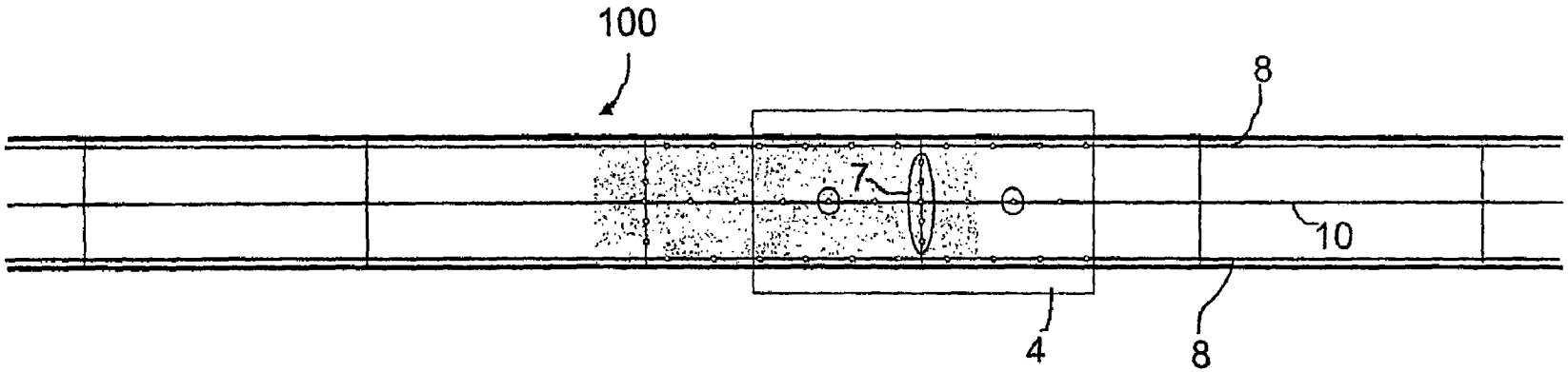
FIG. 2 presents an apparatus according to the invention arranged in a tunnel.

FIGS. 1 and 2 present a solution according to the invention especially in conjunction with a tunnel. 100. The figures show a part of a fire extinguishing system in the tunnel in simplified and diagrammatic form. The system typically comprises a pump unit 1 and a pipeline 3, through which an extinguishing medium, pumped by the pump, is supplied into the piping network of the tunnel when the system is active. In the figure, the piping network comprises two main pipelines 8 and between these a central main pipeline 10. The figure presents the system in a diagrammatic top view. Between the main pipelines 8 there is formed at least one transverse pipe 5, which preferably connects the main pipelines as well as the optional central main pipeline 10 to each other. The transverse pipe 5 is provided with first spraying heads 6, which in an activated state are mainly intended to produce a curtain 7 of extinguishing medium, typically a curtain of aqueous extinguishing medium, in a transverse direction relative to the tunnel. The first spraying heads may be e.g. spraying heads as presented in FIG. 5 in specification WO 0126742, which are provided with a protecting means covering at least one nozzle of the spraying head when non-activated. The protecting means, such as a protective cup, is released when the spraying head 6 is activated.

The pipelines 3 and 8 are typically wet pipes, in other words, they always contain extinguishing medium, such as water. The nozzles 6 in the transverse pipe 5 that produce the curtain of extinguishing medium are typically open nozzles. In the non-activated state, the transverse pipe 5, 5' is separated from lines 8 by means of valve elements 16, 16', e.g. solenoid valves. The valves 16, 16' are opened either on the basis of detection, e.g. detection by a detector element 17, or by using valve elements 16, 16' consisting of special heat-activated pilot valves.

Figure 3:
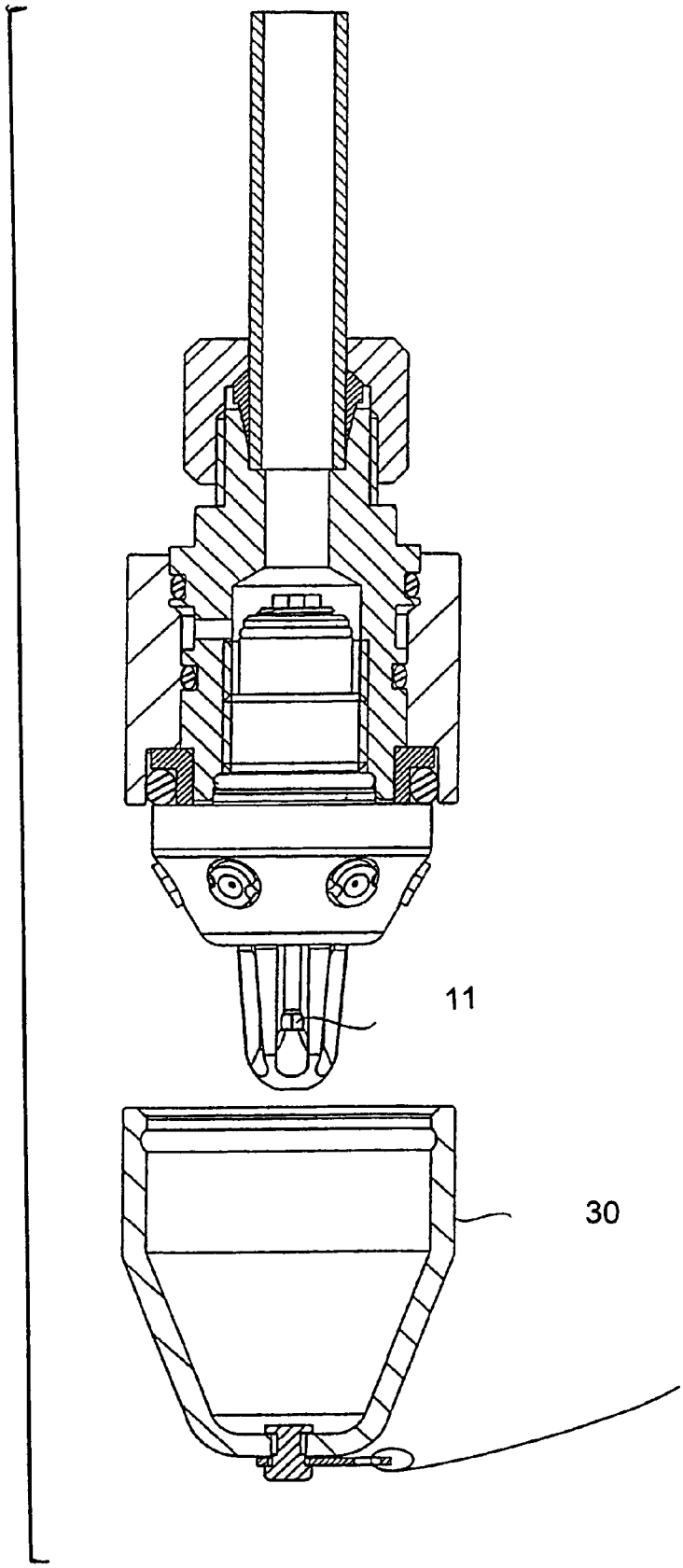
FIG. 3 is an exploded view of a second spraying head with a protective element pre-activated by release from the spraying head.

In FIG. 1, we can assume that a signal has been received from a detector 17 in fire zone 4. This causes the valve elements 16 to open, allowing the extinguishing medium to flow into the transverse pipeline 5. As the pump in the pump unit 1 is pumping the extinguishing medium into pipeline 3, the extinguishing medium flows into the transverse pipeline 5, where the protective cups of the spraying heads 6 are released and the spraying heads 6 start spraying the extinguishing medium, forming a transverse curtain 7 of extinguishing medium, especially a curtain of a mist of extinguishing medium. Instead of the spraying heads producing a curtain of extinguishing medium or in addition to them, it is also possible to activate other spraying heads 13 during the first stage, depending on the application. In FIG. 1, there are spraying heads 13 arranged on the central pipeline 10. At the same time, the system pre-activates and at least some of the protective elements, such as protective cups, of the second spraying heads 11, 12 are released. The protective element covers at least one nozzle and/or heat-activated triggering means of the spraying head. The second spraying heads 11, 12 typically comprise a heat-activated triggering element, which releases the spraying head to produce a spray of extinguishing medium. The second spraying head 11, 12 provided with a protecting means 30 of FIG. 3 may be e.g. a spraying head or sprinkler head provided with a heat-activated triggering means as further presented in Fig. 1–4 in specification WO 0126742. In the solution presented in the figure, the pipelines 8 placed at the edge areas of the space are provided with second spraying heads 11, whose protective element is released by a signal obtained via a control line 9. The signal may be e.g. a hydraulic or pneumatic pressure signal. A spraying head that uses a hydraulic or pneumatic pressure signal for releasing the protective element 30 is also presented e.g. in specification WO 0126742. In the solution presented in FIG. 1, when the valve elements 16 are opened, liquid is also admitted into the control line 9, causing ihe second spraying heads 11 In fire zone 4 to be pre-activated. When the second spraying heads 11, 12 have been pre-activated by removing the protective element covering the heat-activated triggering means, the fire extinguishing system in fire zone 4 is in an activated state of readiness. The spraying heads 6 arranged in the transverse direction of the fire zone now spray a transverse curtain 7 of extinguishing medium and the pre-activated second spraying heads 11, 12 in a state of readiness are ready to spray extinguishing medium as soon as the temperature around them rises high enough. The heat-activated triggering means may typically be e.g. an ampoule adjusted to be broken when the temperature exceeds a predetermined value. Other triggering means are also known which can be applied in the solution of the invention, depending on the embodiment. In the solution of the invention, in addition to spraying heads as disclosed in specification WO 0126742, it Is also possible to utilize other spraying heads provided with a protective means. The first spraying heads could even be implemented without protective elements, but in conditions susceptible to soiling, such as in road or railway tunnels, the use of spraying heads without protective elements is undesirable.

The solution of the invention thus also concerns a method for extinguishing a fire in a space, especially a tunnel or equivalent, in which method an extinguishing medium is sprayed in the space through spraying heads. In a first stage of the method, the flow and temperature of the hot gases produced by the fire are influenced by spraying an extinguishing medium into the space, especially by creating in the space at least one curtain 7 of extinguishing medium, and at least some of the spraying heads 11, 12 in the space are pre-activated into a state of readiness, and in a second stage at least one spraying head is activated to produce a spray of extinguishing medium. During the first stage, a curtain of extinguishing medium 7 is formed substantially in a transverse direction relative to the space. The curtain 7 of extinguishing medium is produced by means of spraying heads 6, which are disposed in a transverse direction across the space. When the spraying heads 11, 12 are to be pre-activated into a state of readiness, the protective means of at least one nozzle and/or heat-activated triggering means of the spraying head is released. On the one hand, the protective means protects the nozzles and/or the heat-activated triggering means from dirt and/or mechanical damage and, on the other hand, from heat, preventing the triggering of a non-activated spraying head. In the method, the space is divided into fire zones 4. In the fire zones 4, at least one curtain 7 of extinguishing medium is formed when necessary and at least some of the spraying heads 11, 12 in the fire zone in question are pre-activated into a state of readiness either manually or on the basis of a signal given by a fire detector. Adjacent fire zones are so formed that they partially overlap at least In their edge areas.

The extinguishing medium used is usually an aqueous liquid and/or a mixture of an aqueous liquid and a gas. Through the spraying heads, a mist of extinguishing medium, typically water mist is sprayed. The droplet size ($D_{v90}$) of the mist of extinguishing medium is typically below 400 micrometers, preferably below 300 micrometers, most preferably below 200 micrometers.

The extinguishing medium is sprayed at a high pressure, preferably 10–300 bar. The pressure in the piping is typically over 30 bar, preferably over 50 bar, most preferably over 70 bar. In connection with the method, typically a pump unit with a constant-pressure pump is used.

An apparatus according to the invention for extinguishing a fire in a space, especially a tunnel or equivalent, comprises spraying heads arranged in the space and a piping system for conveying an extinguishing medium to the spraying heads. The apparatus comprises first nozzles, preferably mounted on first spraying heads 6, for forming at least one curtain of extinguishing medium 7 in the space and a number of spraying heads 6, 11, 12 provided with a protective element, such as a protective cup, for protecting at least one nozzle and/or heat-activated triggering means of the spraying head, said apparatus being used in a stage-wise manner, wherein in a first stage at least one curtain 7 of extinguishing medium is formed, preferably by means of first nozzles of first spraying heads 6, and a number of second spraying heads 11, 12 are pre-activated by releasing the protecting element covering the nozzle and/or heat-activated triggering means, and in a second stage one or more of the second spraying heads 11, 12 are activated to produce a spray of extinguishing medium. The nozzles used to form the curtain of extinguishing medium have been arranged to produce a curtain of extinguishing medium in a substantially transverse direction relative to the space. In a non-activated state, the spraying heads 6, 11, 12 are provided with protective elements protecting at least one nozzle and/or heat-activated triggering means of the spraying head.

The apparatus is divided into several fire zones 4 by means of valve elements 16, 16' and check valves 14, 15. The apparatus comprises at least one, preferably several detectors 17 for detecting a fire.

The apparatus comprises spraying heads 11 disposed in the edge areas of the space. At least the spraying heads 11 disposed in the edge areas are typically placed at a height of 3–5 m from the floor level of the space. In the embodiment illustrated in the figure, the apparatus also comprises spraying heads 12 disposed in the central area of the space, which a mounted on the central main pipeline 10. The apparatus can be adapted according to each place of application, so that e.g. the number of adjacent main pipelines in the piping system and the distances between spraying heads may vary. Instead of and/or in addition to the spraying heads 6 used for forming a curtain of extinguishing medium, the apparatus may comprise spraying heads 13 which are activated to produce a spray of extinguishing medium during the first stage.

The solution of the invention is particularly well applicable for use in tunnels. In this case, the system typically comprises numerous successive fire zones 4. The fire zones are formed e.g. by means of valves 16, 16' and check valves 14, 15. In the event of a fire, e.g. in consequence of a signal received from a fire detector 17, typically several fire zones 4 are activated into the first stage, during which curtains 7 of extinguishing medium are formed and spraying heads 11, 12 are pre-activated. An actual, accurately focused extinguishing action is only started after at least one of the second spraying heads is activated to produce a spray of extinguishing medium. Spraying heads may be pre-activated on one first side or on one second side of the curtain of extinguishing medium or on either side of the curtain of extinguishing medium. If several curtains of extinguishing medium are formed during the first stage, pre-activation of spraying heads can be performed e.g. in the area between curtains of extinguishing medium. Naturally this depends on how the fire zones have been formed in the space and, in the case of a plurality of fire zones, on which zones have been pre-activated. In a typical case, it is thus possible that several zones are pre-activated in the space, such as a tunnel, but triggerings of spraying heads during the second stage typically only occur in the area on fire.

In the solution of the invention, typically the applicant's own spraying heads are used, which are capable of producing an extinguishing medium jet that has a good capability of penetrating into the area on fire.

It is obvious to the person skilled in the art that the invention is not limited to the embodiments described above, but that it may be varied within the scope of the claims presented below. In the description, several characteristic features are sometimes used in combination. The features may also be used separately from each other in connection with the invention.

The invention claimed is:

1. Method for extinguishing a fire in a space in which method an extinguishing medium is sprayed in the space by means of spraying heads, characterized in that, in a first stage of the method, the flow and temperature of the hot gases produced by the fire are influenced by spraying an extinguishing medium into the space, and at least some spraying heads (11, 12) in the space are pre-activated into a state of readiness, and in a second stage at least one spraying head is activated to produce a spray of extinguishing medium.

2. Method according to claim 1, characterized in that, during the first stage, the curtain (7) of extinguishing medium is formed in a substantially transverse direction relative to the space.

3. Method according to claim 1, characterized in that the curtain (7) of extinguishing medium is formed by means of spraying heads (6) arranged in a transverse direction relative to the space.

4. Method according to claim 1, characterized in that, when the spraying heads (11, 12) are to be pre-activated into a state of readiness, a protective means protecting at least one nozzle and/or heat-activated triggering means of the spraying head is released.

5. Method according to claim 1, characterized in that, in the method, the space is divided into zones (4).

6. Method according to claim 1, characterized in that the space is divided into fire zones (4), and at least one curtain (7) of extinguishing medium is formed in each one of said zones when necessary and at least some of the spraying heads (11, 12) in the fire zone in question are pre-activated into a state of readiness either manually or on the basis of a signal given by a fire detector (17).

7. Method according to claim 1, characterized in that the extinguishing medium used is an aqueous liquid or a mixture of an aqueous liquid and a gas.

8. Method according to claim 1, characterized in that a mist of extinguishing medium is sprayed through the spraying heads.

9. Method according to claim 1, characterized in that the extinguishing medium is sprayed at a high pressure, preferably 10–300 bar.

10. Method according to claim 1, characterized in that adjacent fire zones are so formed that they partially overlap at least in their edge areas.

11. Apparatus for extinguishing a fire in a space, said apparatus comprising first and second spraying heads arranged in the space and a piping system for conveying an extinguishing medium to the spraying heads, characterized in that the apparatus comprises first nozzles for forming at least one curtain (7) of extinguishing medium in the space and a protective element for at least one of the second spraying heads (11, 12) for protecting at least one nozzle or heat-activated triggering means of the at least one of the second spraying heads, wherein in a first stage the flow and temperature of the hot gases produced by the fire are influenced by spraying an extinguishing medium into the space from the first spraying heads (6), and the at least one of the second spraying heads (11, 12) is pre-activated by releasing the protecting element covering the nozzle or heat-activated triggering means, and in a second stage the at least one of the second spraying heads (11, 12) is activated to produce a spray of extinguishing medium.

12. Apparatus according to claim 11, characterized in that the nozzles used to form a curtain of extinguishing medium have been arranged to form a curtain (7) of extinguishing medium in a substantially transverse direction relative to the space.

13. Apparatus according to claim 11, characterized in that, in a non-activated state, the spraying heads (6, 11, 12) are provided with protective elements protecting at least one nozzle and/or heat-activated triggering means of the spraying head.

14. Apparatus according to claim 11, characterized in that the apparatus has been divided into several fire zones (4).

15. Apparatus according to claim 11, characterized in that the apparatus has been divided into several fire zones by means of valve elements (126, 16') or check valves (14, 15).

16. Apparatus according to claim 11, characterized in that the apparatus comprises at least one detector (17) for detecting a fire.

17. Apparatus according to claim 11, characterized in that the apparatus comprises spraying heads (11) disposed in the edge areas of the space.

18. Apparatus according to claim 11, characterized in that at least ones of the spraying heads (11) disposed in edge areas are placed at a height of 3–5 m from a floor level of the space.

* * * * *